United States Patent [19]

Gatley

[11] Patent Number: 4,496,047

[45] Date of Patent: Jan. 29, 1985

[54] PACK FOR RAZORS

[75] Inventor: Derrick R. Gatley, Reading, England

[73] Assignee: Wilkinson Sword Limited, High Wycombe, England

[21] Appl. No.: 601,114

[22] Filed: Apr. 18, 1984

Related U.S. Application Data

[63] Continuation of Ser. No. 357,361, Mar. 12, 1982.

[51] Int. Cl.[3] ..... B65D 85/00; B65D 73/00

[52] U.S. Cl. ..... 206/354; 206/208; 206/463; 206/471; 206/493; 206/349; 30/85

[58] Field of Search ..... 206/45.14, 45.26, 349-355, 206/461-465, 208, 228, 471, 476, 486, 487, 492, 493, 495, 565; 30/85, 86, 90; 248/37.3; D9/342; D28/45

[56] References Cited

U.S. PATENT DOCUMENTS

| | | | |
|---|---|---|---|
| 1,381,848 | 6/1921 | Rosenbaum | 206/228 X |
| 2,286,704 | 6/1942 | Apt | 206/337 |
| 2,706,041 | 4/1955 | Tate | 206/493 X |
| 3,354,545 | 11/1967 | Shrader | 30/85 |
| 3,783,507 | 1/1974 | Perry | 30/86 X |
| 3,997,091 | 12/1976 | Burnette | 206/493 X |
| 4,140,244 | 2/1979 | Clabby | 206/228 X |
| 4,153,162 | 5/1979 | Samsing | 206/476 |
| 4,266,664 | 5/1981 | Dixon et al. | 206/349 |
| 4,309,821 | 1/1982 | Terry et al. | 30/85 X |
| 4,322,002 | 3/1982 | Iten | 206/493 |
| 4,432,452 | 2/1984 | Kelly | 206/354 |
| 4,445,610 | 5/1984 | Richards | 206/349 |

FOREIGN PATENT DOCUMENTS

| | | | |
|---|---|---|---|
| 2050912 | 1/1981 | United Kingdom | 30/85 X |

*Primary Examiner*—Allan N. Shoap
*Assistant Examiner*—Bryon Gehman
*Attorney, Agent, or Firm*—John K. Williamson

[57] ABSTRACT

The pack consists of a single card having an aperture therein shaped and dimensioned to receive and support the heads of a stack of disposable razors. The handle of each razor contains a slot and the assembled handles are secured to the card by a tongue which extends through the slots in the razor handles and is secured at its opposite ends to the card. In a modification, the slots are formed in the ends of the razor handles and a part of the card extends into each of the slots.

7 Claims, 16 Drawing Figures

PACK FOR RAZORS

This is a continuation of application Ser. No. 357,361, filed Mar. 12, 1982.

BACKGROUND OF THE INVENTION

This invention relates to a pack, sometimes called a display pack or sales pack, for razors, in particular for disposable razors. A disposable razor is one comprising a handle, usually of plastics material, and a blade unit containing one or more blades, both the handle and the blade unit being discarded by the user when he finds that the razor is no longer giving a satisfactory shave.

It is known to provide a pack for supporting a stack of razors comprising a card shaped to engage a portion of each razor.

In the known pack the card is folded so that the handles of the razors are sandwiched between opposite panels of the packs and the heads of the razors are located by wings bent out of the card.

Other razor packs are known in which razors are supported on a card by a blister of transparent material which extends over the razors and is secured around its edges to the card.

The word 'card' is used herein to designate a panel or series of panels of suitable material, including but not limited to cardboard.

A requirement exists for a simple and economic pack for razors which takes up little space and adequately supports the razors contained within the pack.

According to the present invention there is provided a pack for supporting a stack of razors each of which has a slot in the handle of the razor, the pack having a portion thereof adapted to extend into the slots in the razor handles to secure, or to assist in securing, the razors in the pack.

BRIEF SUMMARY OF THE INVENTION

The present invention also provides a pack of razors comprising a card having an opening spaced from the sides of the cards for the reception of a stack of razors, a said stack of razors disposed within the opening such that the plane of symmetry of each razor lies substantially in the plane of the card and a portion of the card extends into a slot in the handle of each razor, and means for holding the heads of the razors to the card.

The present invention further provides a pack of razors comprising a card for supporting a stack of razors, the card having an opening therein, a said stack of razors mounted on the card with the head of each razor disposed within said opening and a portion of each head extending away from the card on opposite sides of said opening, means for holding the handle of each razor to the card and means adjacent the head of each razor for holding the heads of the razors to the card.

BRIEF DESCRIPTION OF THE DRAWINGS

Some constructions of packs in accordance with the invention will now be described by way of example only, with reference to the accompanying drawings in which.

DETAILED DESCRIPTION

Figure 1:
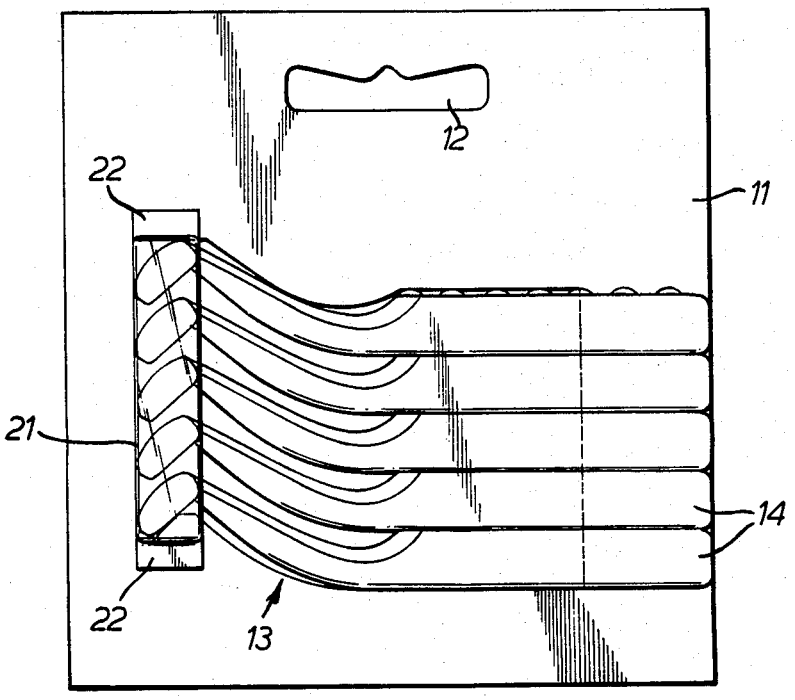
FIG. 1 is a front elevation of one form of the pack.
Figure 2:
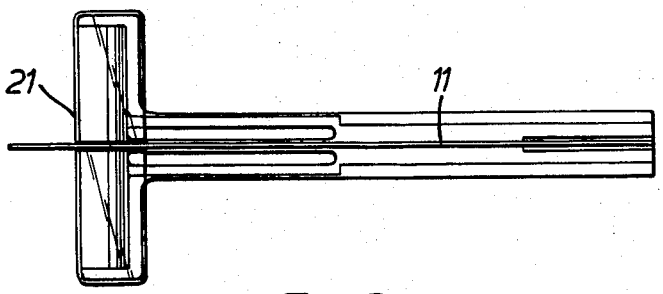
FIG. 2 is a view of the pack of FIG. 1 as seen from above.
Figure 3:
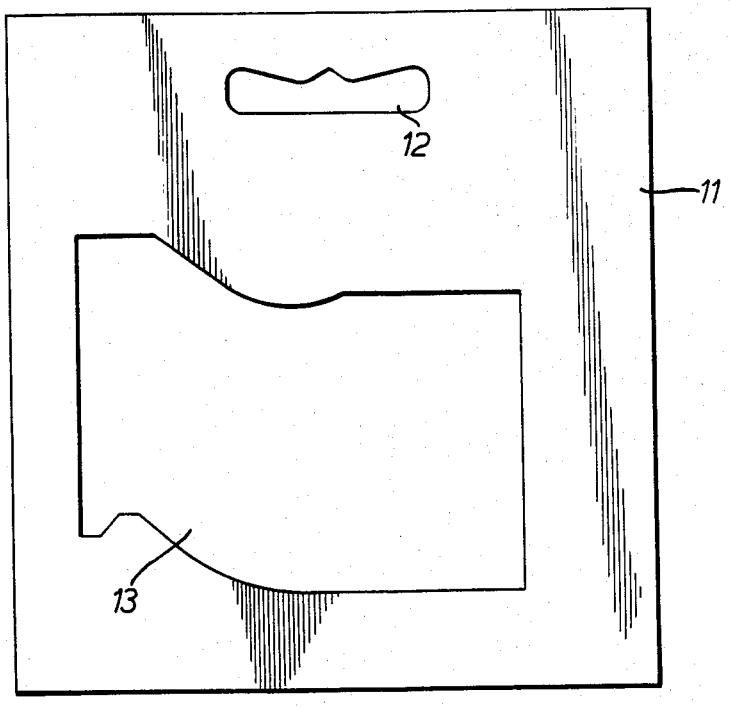
FIG. 3 is a front view of the card on which the razors of the pack will be fitted to form the pack.
Figure 5:
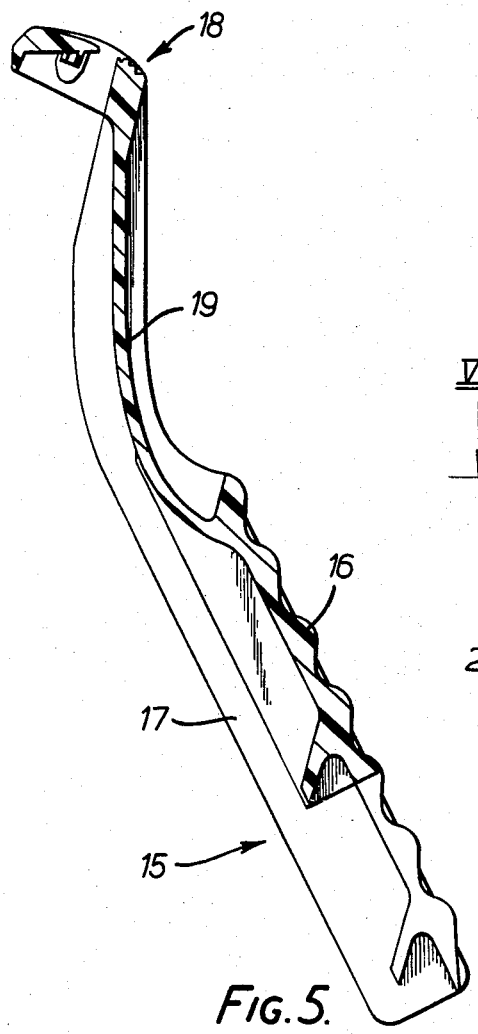
FIG. 5 is a section on the line V—V of FIG. 4.
Figure 4:
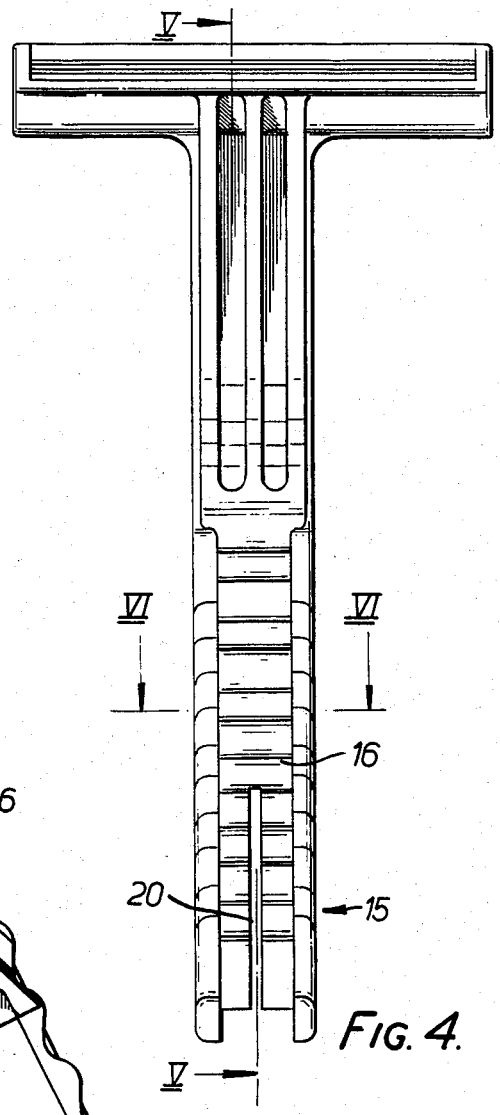
FIG. 4 is a front elevation of a razor for which the pack is designed.

The display pack of FIG. 1 is based on a card 11 (see also FIG. 3) of rectangular shape having a standard European slot 12 formed adjacent one side to receive the arm of a display rack, and an aperture 13 shaped to receive a stack of razors 14, such as for example that shown in FIGS. 4 and 5. The razors of the stack can be shaped to simply stack against one another in front to back relationship, or to nest one within the other, or to lock one within the other. In each case, the head of each razor will preferably overlap the head of the next adjacent razor so that only the blade of one of the endmost razors will face outwardly from the stack.

Figure 6:
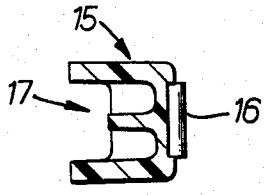
FIG. 6 is a section on the line VI—VI of FIG. 4.

A suitable razor, as shown in FIGS. 4, 5, and 6 has a handle 15 of trough section, with a rib 16, upstanding from the outer side of the base of the trough. The rib 16 extends along the handgrip portion of the handle and is of a width designed to fit into the trough 17 of the next adjacent razor in the stack. The trough 17 and the rib 16 are dimensioned to produce a fit which is sufficiently tight to hold the razors together against normal vibration, but not so tight as to prevent easy manual separation of the razors by a user.

The razor handle 15 is connected to a head 18 of the razor by a curved neck 19 which is also of trough shape on its forward and rearward side.

At the end of the handle remote from the head, the base of the trough is formed to define a slot 20 into which a portion of the card, forming a boundary edge of the aperture in the card, can engage.

The aperture 13 in the card is shaped and dimensioned on all sides to engage or lie close to the adjacent faces of the adjacent razors, and at the ends of the handles remote from the head and on the rear of the rearmost handle of the stack, the boundary edge of the aperture in the card will engage the slots and the recesses of the adjacent razor handles to assist in holding the stack of razors within the card sufficiently for display and transport purposes.

To secure the heads of the razors to the card, a single C section cap 21 is fitted over the razors heads, and tabs 22 bent out of the cap at the upper and lower ends are secured to the card by adhesive or other means.

Figure 7:
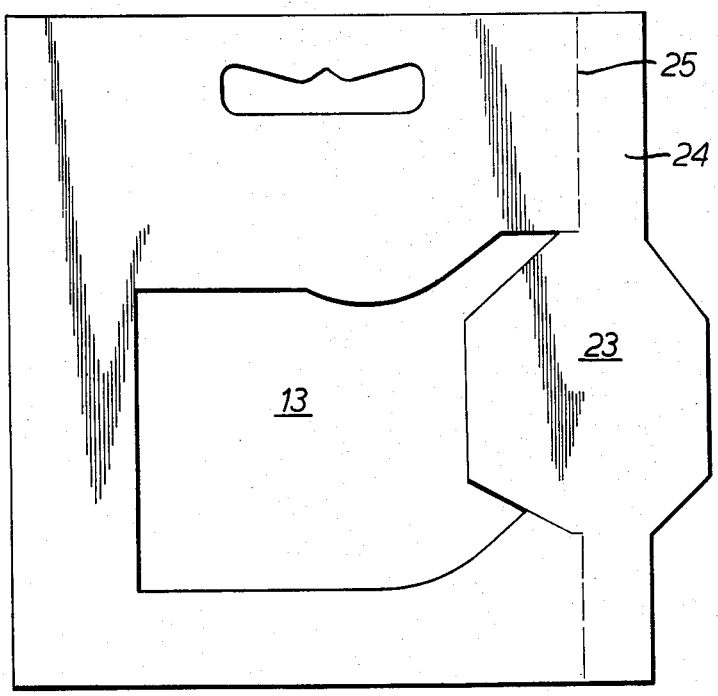
FIGS. 7 and 8 are views corresponding to that of FIG. 3, of two alternative forms of card.

In the modification of FIG. 7, the portion of the card adjacent the heads of the razors is enlarged to provide an area 23 on which a bar code can be applied and the whole strip 24 of the card lying adjacent the heads of the razors is bent through 90° along a fold line 25 to lie perpendicular to the razor handles. The heads of the razors can be secured to the strip 24 in any suitable manner.

Figure 8:
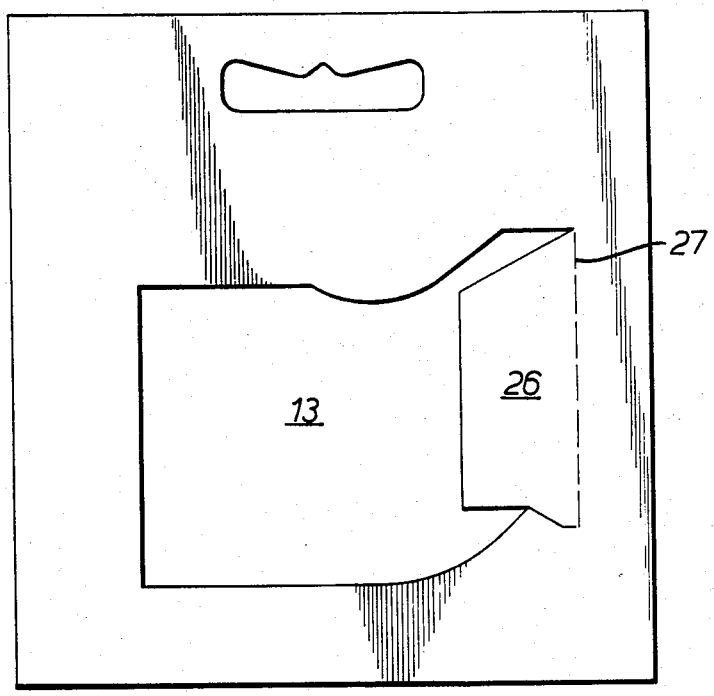

In the modification of FIG. 8, a portion 26 of the card, at the right-hand side of the card as seen in the drawings, projects into the razor aperture of the card when the card is flat. This portion, which is designed to receive a bar code, is then bent about fold line 27 through 90° for attachment to the heads of the razors as in the embodiment of FIG. 7.

Although reference has been made to a single C section travel cap extending around the heads of the stack of razors and secured by tabs at its upper and lower ends, other arrangements for supporting the heads of the razors on the card can be adopted.

For example, instead of the upper and lower tabs 22 shown in FIG. 1, a pair of adjacent tabs could be formed to extend longitudinally of the cap and define between them a slot into which the adjacent boundary edge of the aperture 13 could fit to secure the cap of the card. Alternatively an aligned series of pairs of adjacent tabs could be provided for the same purpose. As a further alternative, tabs, such as 22 (FIG. 1), could be provided at other locations on the cap, and bonded or otherwise secured to the card. Again, one or more tongues, in particular barbed tongues, could be formed on the cap, and thrust through an adjacent part of the card to secure the cap to the card.

If the razors are designed to interlock, only one travel cap is needed, shaped to fit over the razor head having the exposed blade, and secured to the card by any of the above-mentioned means.

If the razors are not interlocking, a single cap can be provided on the razor head having the exposed blade, and a tongue formed to extend from the single cap and engage around the razor at the opposite end of the stack to secure the razors to each other.

As a further alternative, a cap to fit over all the razors heads can be formed with a separate compartment for each razor head, each compartment being formed to releasably lock the razor head within the compartment. This cap can be similar to known shaving unit dispensers of the type in which each shaving unit is releasably and resiliently secured within a separate compartment of the dispenser. Such a compartmented cap could be secured to the card by any of the above described means. In particular it could be readily bonded to an area of the card such as 23 in FIG. 7 or 26 in FIG. 8.

Figure 9:
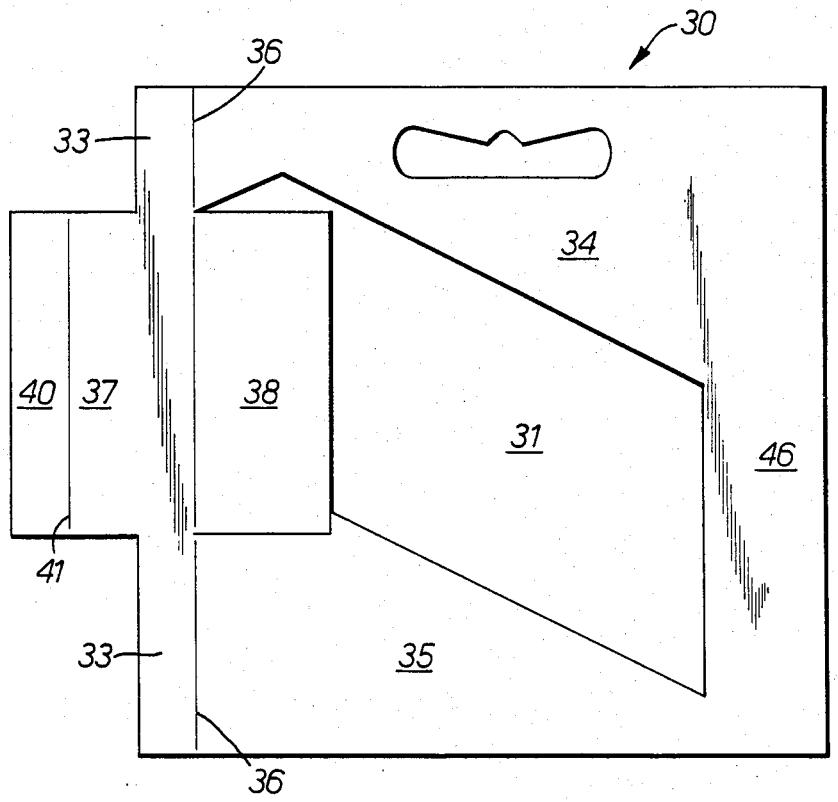
FIG. 9 is a plan view of a card blank from which a pack for containing five razors, according to another embodiment of the invention, can be formed.
Figure 10:
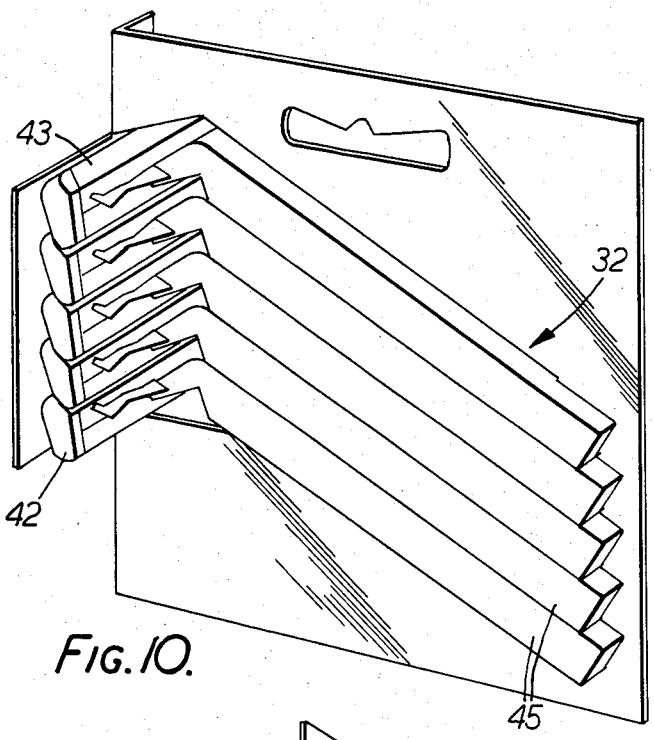
FIGS. 10 and 11 are perspective views of the pack of five razors mounted on the card of FIG. 9 after folding of the card.
Figure 11:
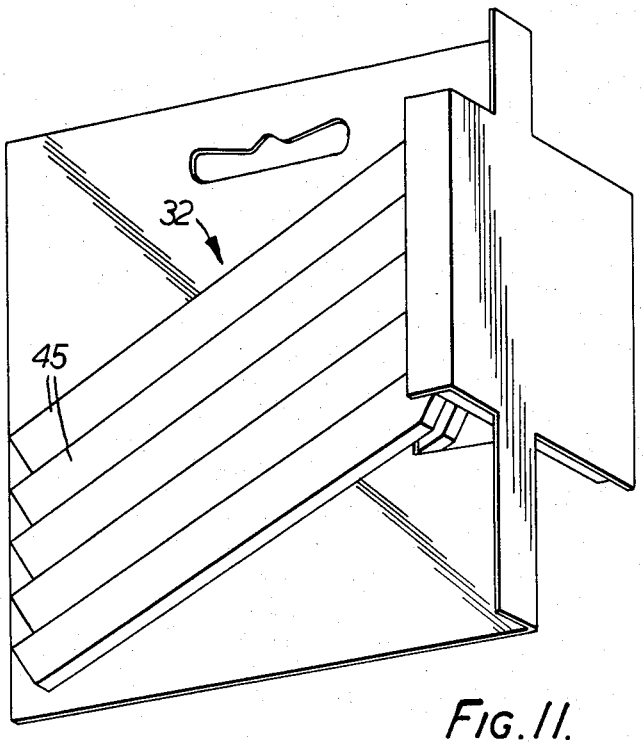

A further embodiment of the invention is shown in FIGS. 9, 10 and 11. FIG. 9 shows a card 30 having an aperture 31 therein into which a stack of razors 32 can be fitted after folding of the card, the razors being disposed one above the other and, if desired, with each razor nesting with the next adjacent razor or releasably fitted to the next adjacent razor.

The aperture 31 is formed to leave, on the left hand side thereof as seen in FIG. 9, an area of the card which in this embodiment is of cruciform shape, and joined to the top and bottom panels 34, 35 of the card along a fold line 36. This area of the card can be regarded as comprising a narrow panel 33 extending from the top to bottom of the card with wings 37, 38 extending in opposite directions from the elongate sides of the panel 33. The extent of each wing longitudinally of panel 33 corresponds to the distance occupied by the heads of a stack of razors. The outer portion 40 of one wing 37 (as shown) or if desired of each wing, can be folded along a fold line such as 41 which is parallel to line 36, the remainder of the wings having a combined width corresponding to the width of a razor head.

As shown in FIGS. 10 and 11 the razors 32 to be accommodated in this pack can each be provided with a travel cap 42 on the head 43 of the razor and with a slot (like slot 20 of FIG. 4) extending into the handle 45 from its outer end.

In assembling a pack, the card 30 is first bent along fold line 36 so that the narrow panel 33 extends perpendicular to the adjacent panels 34, 35 of the card on the opposite side of line 36. The outer portion 40 of the wing 37 (or of each wing) is then folded about the line 41 to lie parallel to the panels 34 and 35 of the card, and can be bonded by adhesives to the adjacent end of each travel cap.

The razors to be fitted in the pack are first stacked so that the slots therein lie in a common plane, and, after flexing the card, the handles 45 are fitted over the edge of the remaining panel 46 of the card which interconnects the panels 34, 35 and lies opposite the panel 33. Finally, the end of each travel cap 42 can be connected by adhesive to the folded outer portion 40. If a folded outer portion is provided on each wing, the folded outer portions can be caused to adhere to the opposite ends of each travel cap. If the travel caps make contact with the wings over a sufficient area, they could additionally or alternatively be caused to adhere to the wings. As an alternative, the handles can first be engaged with panel 46, and the opposite panels can be folded subsequently to fit around the razor heads.

In a modification of this embodiment, the individual travel caps are replaced by a single multi-compartment travel cap (similar to the multi-compartment dispenser which has been used for releasably containing shaving units). This single travel cap is shaped as a recessed tray which can be secured by adhesive to the wings. The folded portion or portions of the wings can thus be omitted.

After release of a razor handle from the card, by breaking the panel 46 of the card fitted into the handle or otherwise, the razor having an individual travel cap can either be snapped out of the travel cap leaving the cap attached to the card, or the travel cap can be detached from the folded portion 40 of the wing and subsequently removed from the razor. In the case of a single travel cap for all the razors, each razor head will be snapped out of the single cap.

Each of the embodiments of the invention has been described above in relation to a pack of five razors, but it will be evident that packs of different numbers, in particular ten razors, can be formed by increasing the depth of the aperture and consequently the depth of the card and of the parts of the card which support the heads of the razors.

Figure 12:
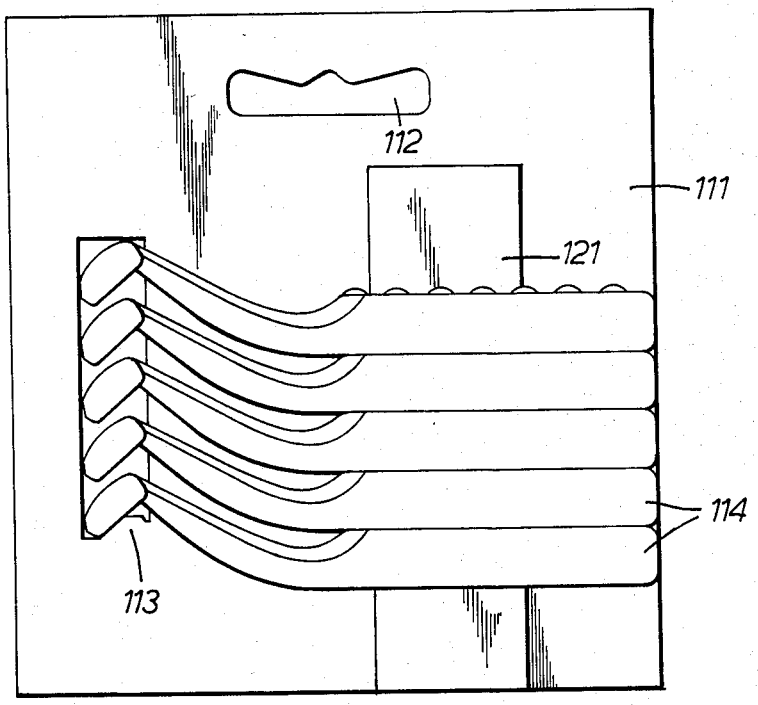
FIG. 12 is a front elevation of another form of pack containing razors.
Figure 13:
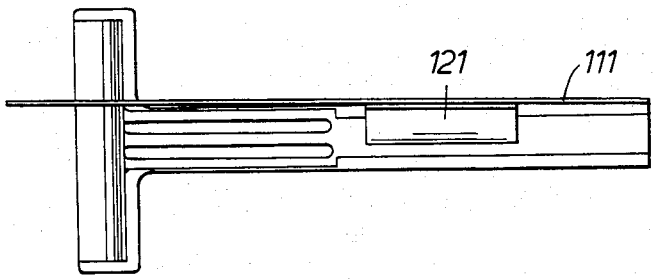
FIG. 13 is a view of the pack of FIG. 12 as seen from above.
Figure 14:
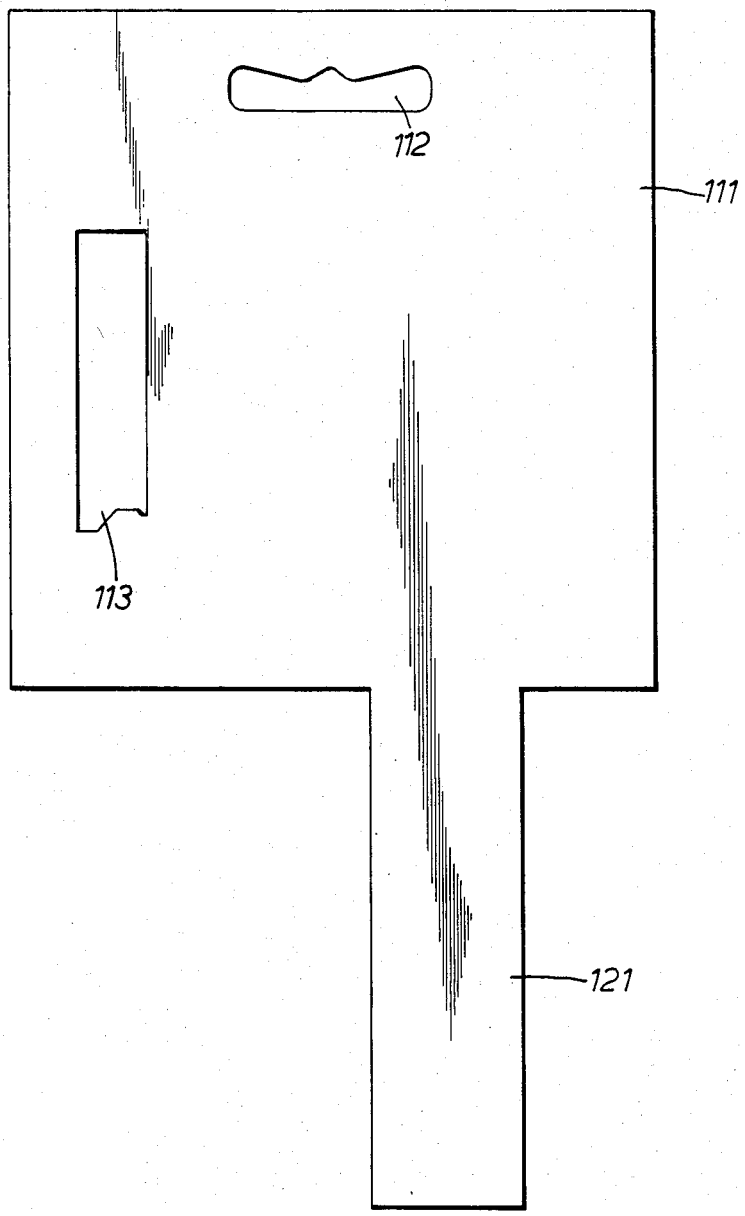
FIG. 14 is a front view of the card on which the razors of the pack of FIG. 13 will be fitted to form the pack.

Another embodiment of display pack is shown in FIG. 12 in which the display pack is based on a card 111 of rectangular shape having a standard European slot 112 formed adjacent one side to receive the arm of a display rack, and an aperture 113 shaped to receive the heads of a stack of inter-fitting razors 114.

Figure 16:
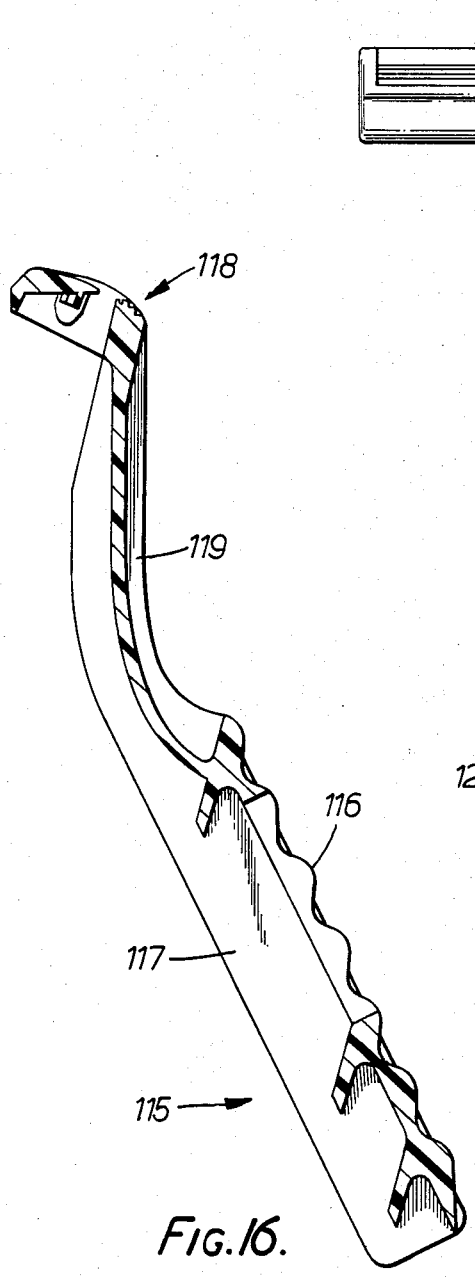
FIG. 16 is a section on the line XVI—XVI of FIG. 15.
Figure 15:
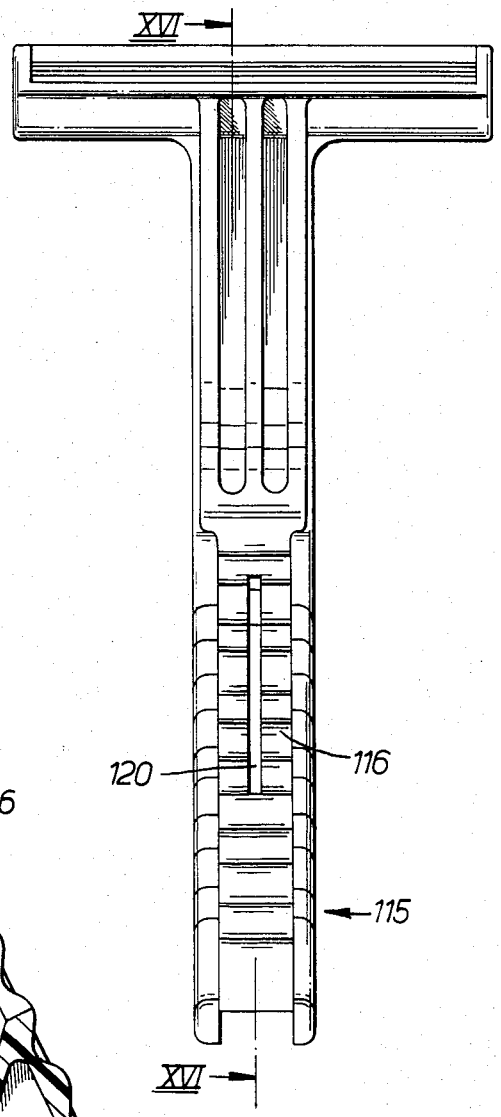
FIG. 15 is a front elevation of a razor for which the pack of FIG. 12 is designed.

As shown in FIGS. 15 and 16, a suitable razor has a handle 115 of trough section, with a rib 116 upstanding from the outer side of the base of the trough. The rib 116 extends along the handgrip portion of the handle and is of a width designed to fit into the trough 117 of the next adjacent razor in a stack. The trough 117 and the rib 116 are dimensioned to produce a fit which is sufficiently tight to hold the razors together against normal vibration, but not so tight as to prevent easy manual separation of the razors by a user.

The razor handle 115 is connected to a head 118 of the razor by a curved neck 119 which is also a trough shape on its forward and rearward side.

At mid position along the length of the handle, a slot 120 closed at its opposite ends is formed to assist in securing the razor to the card in a manner to be described below.

The aperture 113 in the card is so shaped and dimensioned that it can receive an assembly of, for example, five razor heads, the razors having been stacked in front-to-back relationship.

The card is also formed initially with a tongue 121 extending from the lower side of the card. This tongue is of a width to fit through the slot 120 of each razor handle.

To secure the assembly of razors to the card, the tongue 121 is first fitted through the slots 120 of the assembly of handles, and the tongue is then folded about a line coextensive with the lower edge of the card. The assembly of razors is carried with the tongue, and the razor heads are fitted into the aperture 113 until the razor handles lie in contact with the front face of the card. The free end portion of the tongue is then secured to the card, for example by adhesive or stapling.

Preferably each razor is provided with a separate travel cap which need not be attached to the card. however, if desired, a common travel cap can be used and this will preferably be secured to the card by means similar to those described in relation to the first embodiment.

In a modification of this embodiment, the tongue is formed separately from the card. The assembly of razors in this case can first be placed on the card, so that the razor heads project through the aperture 113. The tongue is then fitted through the slots of the assembled razors and is secured at its opposite ends to the card, for example by adhesive or stapling.

If desired, the handles can be shaped to lock resiliently together yet be easily separable.

Although the various embodiments of the invention described and illustrated herein have included razors stacked together in front-to-back relationship, the invention could be applied to razors stacked in a staggered side-by-side relationship in which case the slot in each razor handle would extend between the left and right hand sides of the handle.

I claim:

1. A pack of razors comprising a card having an opening spaced from the sides of the card for the reception of a stack of razors each of which has a plane of symmetry, a head and a handle extending from said head, each handle having a slot therein extending along said handle from the outer end thereof, a said stack of said razors disposed within the opening such that the plane of symmetry of each razor lies substantially in the plane of the card and the card has a portion thereof along the margin of said opening which portion extends into said slot in the handle of each razor at the outer end thereof, and means for holding the heads of the razors to the card.

2. A pack according to claim 1 wherein the razors are stacked in front-to-back relationship.

3. A pack according to claim 1 wherein the means for holding the heads of the razors to the card comprises a cap which fits over at least part of the head of each razor and is secured to the card.

4. A pack according to claim 3 wherein the razors are stacked in front-to-back relationship and wherein the said cap or each said cap fits over a part of the head of each razor extending on opposite sides of said opening.

5. A pack according to claim 1 wherein the means for holding the heads of the razors to the card comprises a separate cap which fits over at least part of each razor head and is secured to the card.

6. A pack according to claim 1 wherein the card has a portion thereof adjacent one side of said opening which has been bent perpendicular to the plane of the remainder of the card, each razor having at least one cutting edge and said portion of the card extends adjacent a said cutting edge of each razor.

7. A pack according to claim 1 wherein the card has a portion thereof adjacent one side of said opening which has been bent perpendicular to the remainder of the card, each razor having a cutting edge or edges and said portion of the card extending across the full width of the head of each razor adjacent the cutting edge thereof.

* * * * *